US009439256B2

(12) United States Patent
Tetik et al.

(10) Patent No.: US 9,439,256 B2
(45) Date of Patent: Sep. 6, 2016

(54) FLICKER-FREE LAMP DIMMING-DRIVER CIRCUIT FOR SEQUENTIAL LED BANK CONTROL

(71) Applicant: LSI Computer Systems, Inc., Melville, NY (US)

(72) Inventors: Attila Tetik, New York, NY (US); Peter J. Visconti, East Setauket, NY (US)

(73) Assignee: LSI Computer Systems, Inc., Melville, NY (US)

( * ) Notice: Subject to any disclaimer, the term of this patent is extended or adjusted under 35 U.S.C. 154(b) by 274 days.

(21) Appl. No.: 14/104,449

(22) Filed: Dec. 12, 2013

(65) Prior Publication Data

US 2014/0159599 A1 Jun. 12, 2014

Related U.S. Application Data

(60) Provisional application No. 61/736,154, filed on Dec. 12, 2012.

(51) Int. Cl.
*H05B 37/02* (2006.01)
*H05B 33/08* (2006.01)

(52) U.S. Cl.
CPC ..... *H05B 33/0845* (2013.01); *H05B 33/0827* (2013.01)

(58) Field of Classification Search
CPC ..... H05B 33/0845
See application file for complete search history.

(56) References Cited

U.S. PATENT DOCUMENTS 7,439,944 B2 * 10/2008 Huynh ..... H05B 33/0818 315/185 S

* cited by examiner

*Primary Examiner* — Hai L Nguyen
(74) *Attorney, Agent, or Firm* — Carter Ledyard & Milburn LLP

(57) ABSTRACT

An LED dimmer circuit to sequentially control multiple banks of LEDs connected in series. The invention is designed to respond to demands for more or less illumination by sequentially turning on or off one or more banks of LEDs. Each bank is turned off or on in response to the phase angle of an AC power source with each LED bank being controlled by a different phase angle.

11 Claims, 9 Drawing Sheets

FLICKER-FREE LAMP DIMMING-DRIVER CIRCUIT FOR SEQUENTIAL LED BANK CONTROL

TECHNICAL FIELD

This invention relates to a driver circuit for Light Emitting Diodes (LEDs) to provide flicker-free dimming of the LEDs. The invention provides the ability to sequentially turn on banks as more brightness is required, and turn off banks as dimming is required, and turn off banks as dimming is required, by setting the control circuitry.

BACKGROUND

In the current state of the art of LED dimmer technology, one of the ways to control multiple banks of LEDs is the use of a series dimmer control. For purposes of the invention a "bank" is defined as a series connection of one or more LEDs. This control works by turning on the LEDs during only a portion of the time at the beginning or end of the positive and negative input sine wave of the AC power source. The control involves various types of semiconductors to implement this switching, but when multiple banks are dimmed, all of the banks dim together, at the same time.

An alternate way of dimming multiple LED banks is to use a Pulse Width Modulated (PWM) control signal going to the driver circuitry. Typically, in the industry, a zero to ten volt pulse signal is applied to the dimming switching device. The wider the pulse that controls the switching device to conduct current to the LED banks, the brighter the LED banks appear. All LED banks behave in unison.

In the first mentioned approach, utilizing a series dimmer circuit, there is the problem of noticeable brightness and visible lamp flicker, especially when there is a dimmer setting for very dim lighting. In addition, if there is minor perturbation of the voltage level, there is a very discernible short term brightening or dimming of the LEDs. This happens to all of the banks simultaneously, since the dimmer circuitry's control setting affects all of the banks at the same time.

SUMMARY

An exemplary LED driver that sequentially illuminates and dims multiple banks is presented as the invention described herein. The invention has the compatibility of working within pre-existing older installations with conventional, old-style phase dimmer controllers that effect the dimmer operation by switching on to conduct current through the LED bank based on the setting of said controller and the instantaneous phase angle of the AC input voltage. As the multiple LED banks are controlled from almost fully dimmed to fully bright settings, at first one bank of LEDs turns on, then the next bank turns on and eventually all banks turn on. As the banks are dimmed each bank is selectively dimmed as described below.

If the implementation of this invention using PWM control is used, as the control response from maximum dimmed to maximum brightness is affected, sequentially, first one bank, then two etc., turn on and brighten until all banks are fully illuminated at maximum brightness. Using the PWM control, since dimming operation is proportional to the pulse width of the control signal, magnification of dimming effects, due to input line voltage variations does not occur, since the proportion of dimming switching is fixed based on the PWM signal, rather than being based on the voltage relating to a particular phase angle. When input AC voltage is reduced due to AC supply voltage variations, there is a phase angle shift that yields a magnification of dimming effects, which results in accentuated dimming proportional to the voltage variation, due to a narrowing of the semiconductor switch's conduction on-time, but not the magnified effect caused by the addition of phase angle shift due to input voltage variations.

BRIEF DESCRIPTION OF THE DRAWINGS

The above and other aspects, features and advantages of the present disclosure will become more apparent in light of the following detailed description when taken in conjunction with the accompanying drawings which.

DETAILED DESCRIPTION OF THE EMBODIMENTS

Figure 1:
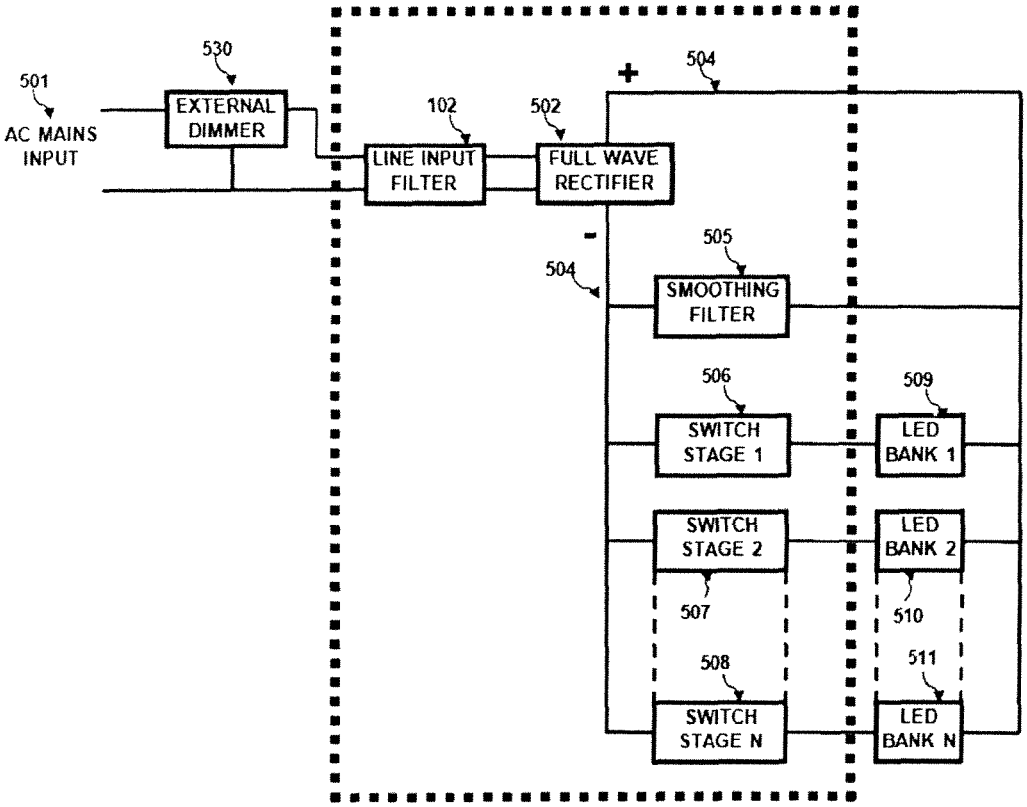
FIG. 1 is a block diagram of the driver implementation when used in conjunction with an external dimmer.

Preferred embodiments of the present disclosure will be described herein below with reference to the accompanying drawings. In the following description, well known functions are not described as such functions would be known to one skilled in the art.

Reference will now be made in detail to exemplary embodiments consistent with the invention, examples which are illustrated in the accompanying drawings. Wherever possible, the same reference numbers will be used throughout the drawings to refer to the same or like parts.

Light Emitting Diodes are shown herein as an array, consisting of one or more LEDs connected in a series connection and referred to as an LED bank. The LED bank is structured by the connection of the cathode of one LED to the anode of the next LED. These arrays do not specify particular colors, but it is within the bounds of this invention that either within each bank or from bank to bank various colors may be implemented.

In a typical prior art LED dimming circuit all of the LEDs in each bank are switched on or off at the same time. Dimming is done externally to the circuit by a device that switches on and off at a specific phase angle of the AC source voltage determined by adjusting a control that varies the phase angle of the AC sine wave. As the light is dimmed, the operating time for the LEDs decrease and they are just lit for a small portion of time during extreme dimming situations. Any anomalies (noise) in the AC sine wave at that time can result in indeterminacy in the LEDs, not lighting at all during that brief period of time, or lighting may appear. This indeterminacy appears as a flicker. This is noticeable when the control is set at the near full dim position. At that time, all of the LEDs are switching on just briefly, in unison and may appear to flicker erratically.

The key feature of this invention is that instead of all of the LED banks operating in unison, this invention has each electrical bank of LEDs turning on and off at different times before and after the sine wave's peak voltage phase angle. This is implemented by varying the resistance of one of two resistors for each voltage divider that generates a control voltage for the LED's switch in each bank. This resistance variation is fixed within a particular hardware design, and the resistor value varies from bank to bank. During extreme dimming, some of the banks of LEDs do not actually turn on at all. The effect of this is that if there are 4 banks for example, during extreme dimming, three banks may be off. It is to be mentioned that each bank has its own series electrical circuit, but the whole lighting assembly has all of the banks in the same general spatial location. By increasing the sheer number of series electrical LED banks, it is possible to go lower and lower in illumination to reduce flicker, since the bulk of the dimming is done by a gradual shedding of the number of LED banks that are on, which happens automatically during the dimming. The resistor divider values are carefully chosen, so as to make a seamless transition of light level as the dimming progresses. It should be understood that the phase angle of the sine wave peak voltage is only one variable characteristic that could be used to control each individual LED bank. Other variable characteristics could include voltage magnitude or pulse width which would be understood by one skilled in the technology pertaining to the preserve invention.

This invention will also work when there is a conventional dimmer in series with the AC power source, such as in pre-existing site wiring situations.

Figure 6:
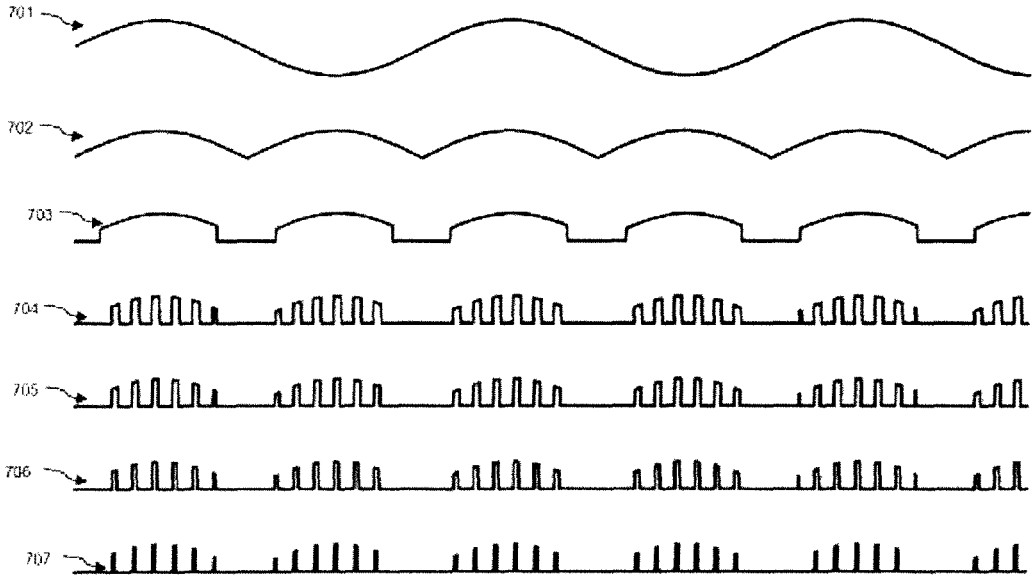
FIG. 6 illustrates signal waveforms with the circuitry configured using external PWM control input.

As shown in FIG. 1 all of the components of the block diagram are within the scope of the invention with the exception of the external prior art dimmer 530 which is attached in series with the AC voltage supply 501 and then fed into one embodiment of the invention. The external dimmer 530 has internal circuitry (not shown) which rapidly switches on and off with the current pulse width in proportion to the physical setting of the external dimmer's control. This switching is synchronous to the AC input signal. The output of 530 may be filtered through an input line filter 102, to remove line transients, interference or conducted line noise outside of the bounds of the AC source fundamental frequency and excessive voltage excursions. The filter's 102 output is then passed into a full wave rectifier 502 which changes the sinusoidal waveform 701 into full-wave pulsating AC 702 as shown in FIG. 6. The full wave rectifier's 504 output is a positive and negative output voltage of pulsating AC caused by current switching of the transistor circuitry. Across the positive and negative output is a smoothing filter 505 which removes high frequency spectral components from the pulsating AC waveform. The positive output of the full wave rectifier is fed to the positive input (anode side) of all of the banks of LEDs, 509-511. Although 4 banks are shown, there may be two or more banks within the scope of this invention. The negative side of the full wave rectifier's output is applied to the negative input of each switch 506-508. There is a switch associated with each LED bank. When the switch is in the "ON" state, the LED bank associated with that switch illuminates.

Figure 2:
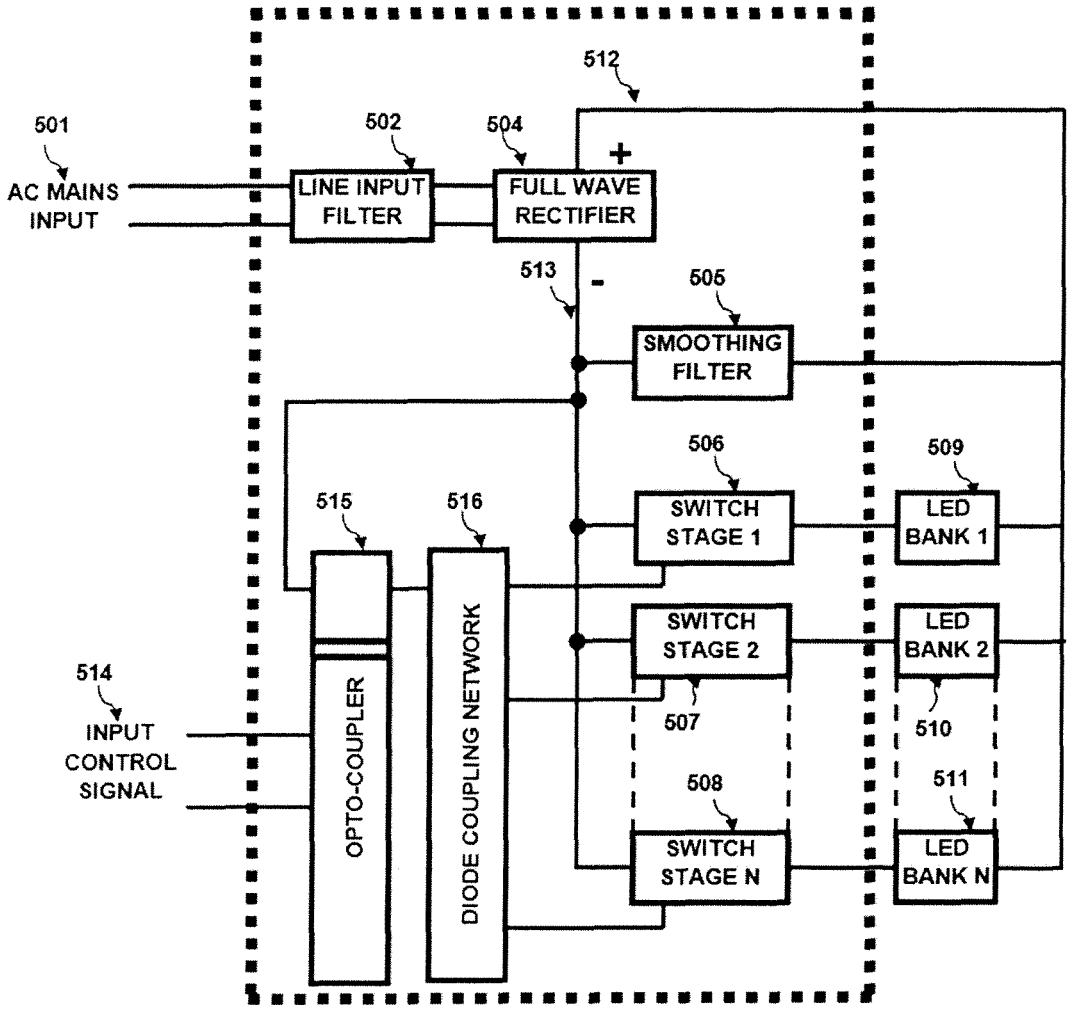
FIG. 2 is a block diagram of the driver implementation when used in conjunction with a PWM control input.

FIG. 2 shows a block diagram implementation for PWM control. The entire circuit embodies the invention. This block diagram does not contain a series external dimmer as shown in FIG. 1 but otherwise is the same except for the inclusion of an opto-coupler 515 and a diode coupling network 516. An input control signal 514 is a digital pulse train which is pulse width modulated by known circuitry not shown. The opto-coupler is a device which consists of an internal LED. When the internal LED is powered, the output light of the LED, which can be either visible or infrared light, shines into the lens of a photodiode/phototransistor. The light going into the photodiode/phototransistor causes the impedance across the opto-couplers output pair of conductors to be drastically reduced. One side of the output of the opto-coupler is connected to the full wave rectifier's negative side. This allows current to be sinked by the opto-coupler when energized. When the opto-coupler is not energized, no current flows through its' output conductors. The purpose of the opto-coupler is to electrically isolate the input control signal (a PWM pulse train) from the lighting power circuitry. This is done for safety and to prevent electrical interactions between the source of the PWM signal and the lighting controls. The diode coupling network is used to isolate the output of the opto-coupler from each of the switch stages, 506-508. The coupling network 516 allows each of the switch stages to be totally disconnected when the PWM represents minimum brightness and for each stage to be individually grounded when the PWM signal is high (LEDs "OFF" signal).

Figure 3:
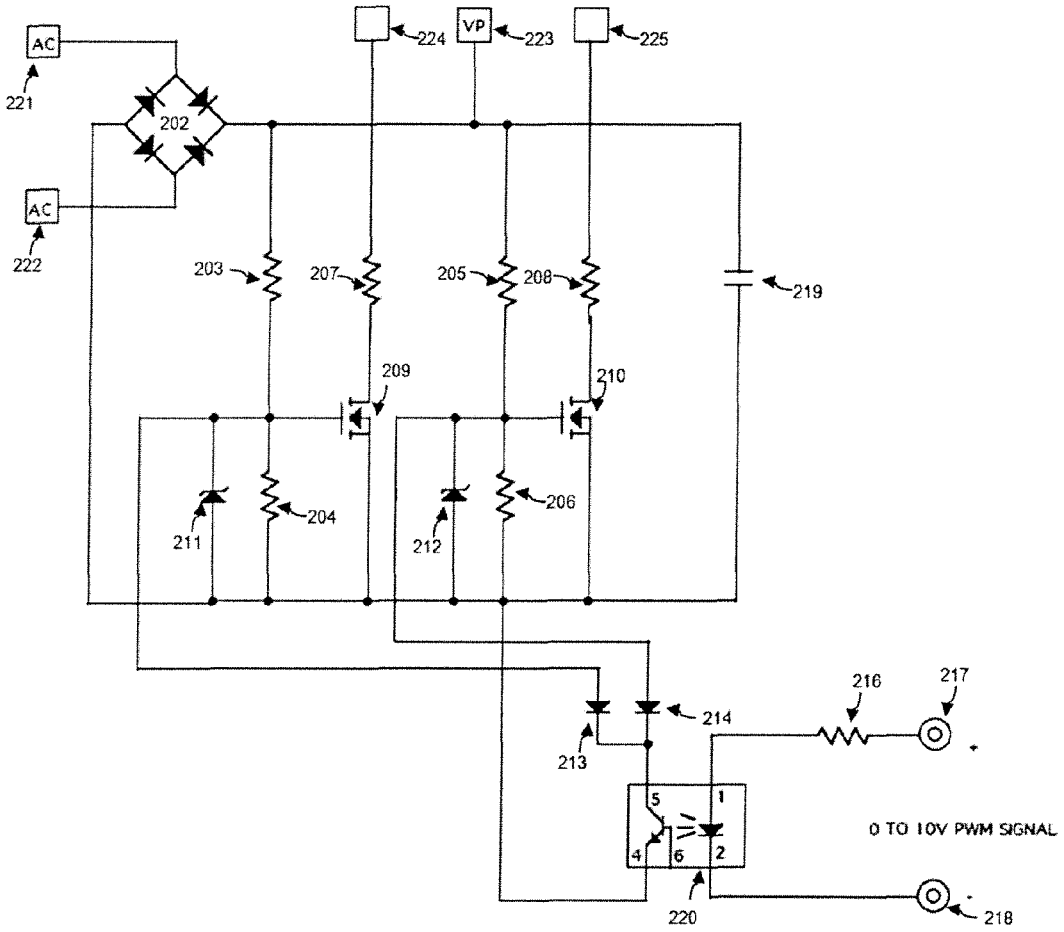
FIG. 3 is a typical circuit implantation of a two bank driver.

FIG. 3 shows a more detailed view of the circuitry of the invention shown in block diagram form in FIG. 2. The AC source inputs, 221 and 222 are applied to the full wave rectifier 202 which consists of four power diodes. In this illustration, the input filter 502 is not shown. A capacitor (combination of capacitors, not shown) 219 smoothes the full wave rectified sine waves at the full wave rectifier's positive output reducing any noise caused by the switching transistors 209, 210. In this particular illustration, a power MOSFET transistor 209, 210 is shown, but this switching device can be another type, and still fall within the purview of this invention such as an SCR or Triac. The Source terminal of each of the two transistors 209, 210 is connected to the negative side of the full wave rectifier's output, which will herein be referred to as the circuit's Ground side. This is not the circuit's system's Earth Ground, but will be used as a simplifying reference. The gate of each transistor is connected to a voltage divider 203, 204 and 205, 206. The voltage divider divides the output voltage of the full wave rectifier to a fraction of the full wave rectifier's voltage. In addition, connected to each of the transistor's 209 and 210 gate input are zener diodes 211, 212, which limit the amount of voltage that can be applied to the gate. This may typically be set at 10VDC, for example. It is to be noted, that the two voltage dividers (203, 204 and 205, 206) produce different voltages from each other and are not identical. This allows one transistor 209 or 210 to turn on before the adjacent transistor and turn off later. Since the transistors turn on and off at different times, they each have a different "ON" time, yielding different amounts of energy to be applied to their respective LED banks, 224 and 225. Different energy applied means that the banks will have the perception of one bank being brighter than the adjacent bank. Series resistors 207 and 208 create a current sink when in combination with the transistor and this drives the cathode side of each of the LED banks. The positive full wave rectified output 223 supplies the anode of each LED bank. Diodes 213, 214 comprise the coupling network 516 (FIG. 2) that is used to pull the gate of the two transistors towards ground to shut them off when there is a zero input voltage on the PWM signal at the positive input 217 relative to the PWM return input 218. This voltage is used to turn on the LED within the opto-coupler 220. A series resistor 216 between the input 217 and the input to the opto-coupler is used to set the value of the current applied to the LED within the opto-coupler. The output of the opto-coupler is used to current sink the two diodes 213, 214 to ground.

Figure 4:
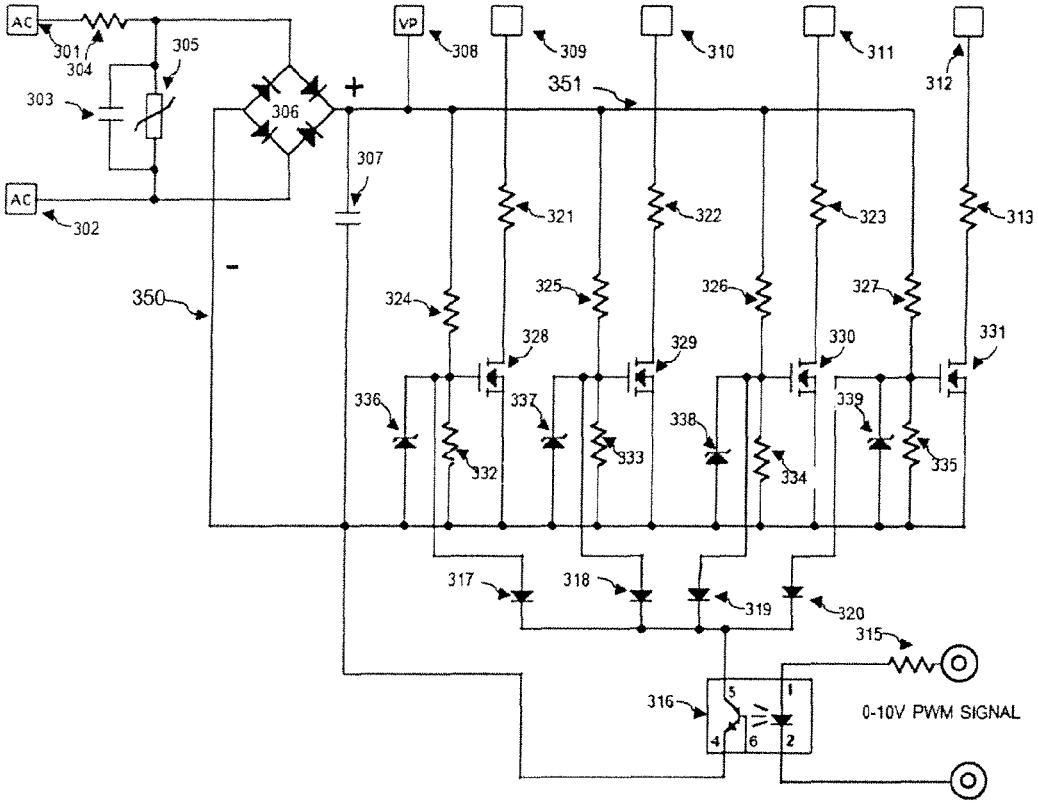
FIG. 4 is a typical circuit implementation of a 4-bank configuration with a PWM control input.
Figure 9:
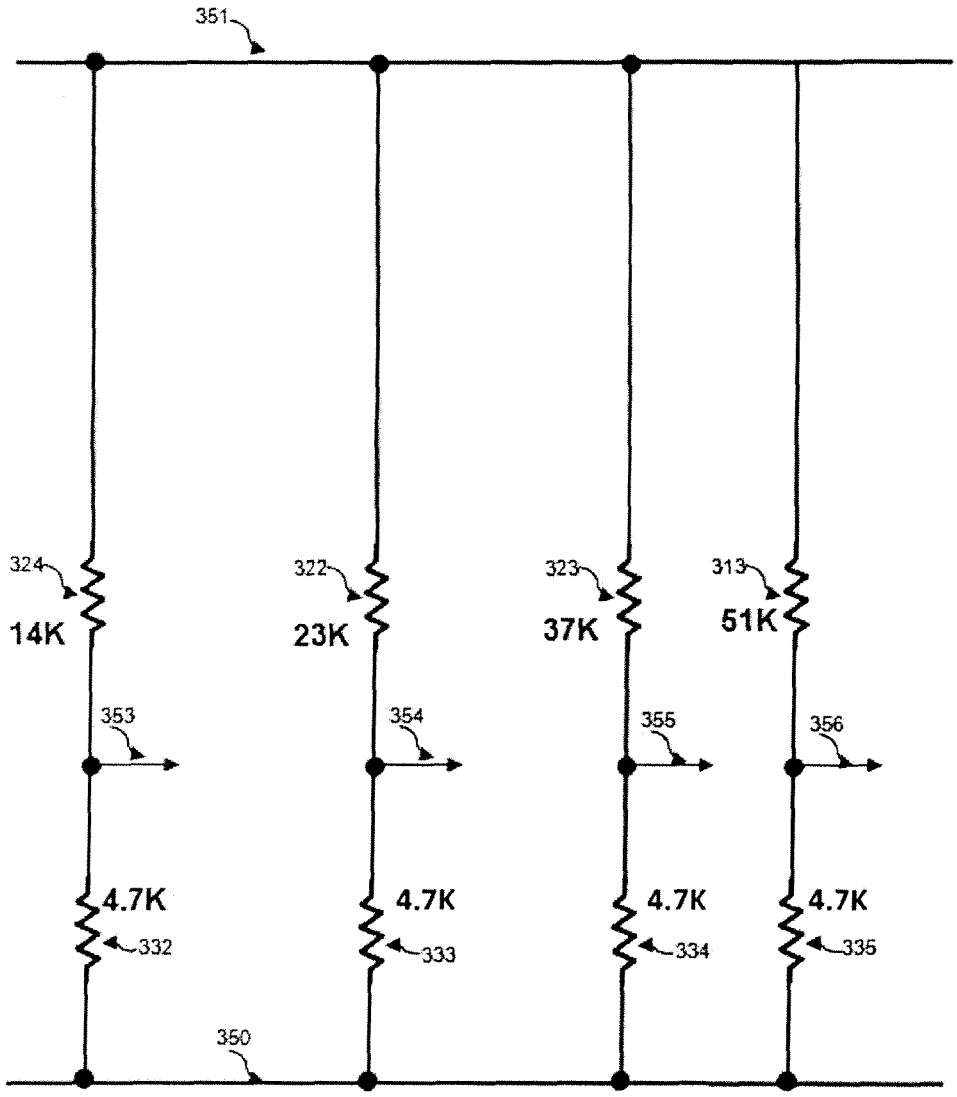
FIG. 9 shows a voltage divider network in accordance with the invention.

FIG. 4 shows an implementation of the same circuit as FIG. 3, except with the addition of the input filter and two additional stages. The input filter consists of three components, a capacitor 303, an MOV or thyristor 305 and a series resistor 304. The capacitor (or combination of capacitors, not shown) and resistor combination form a single pole low pass filter that reduce any high frequency noise coming in from the AC power line. Across the capacitor, is either an MOV or thyristor 305 or other device that is used to reduce any high voltage transients coming in to the line. The switching transistor's 328, 329, 330, 331 gate inputs are connected to a voltage divider as previous described. An exploded view of the voltage dividers is shown in FIG. 9. The positive supply 351 goes to the top side of the divider and the supply return 350 which is the local circuit Ground is connected to the bottom of each resistor divider. It is to be noted that each resistor divider has a different resistance for the top resistance value. This results in a different amount of voltage division between each stage. At the juncture of each pair of resistors are the outputs that go to their transistor's gate. Refer to FIG. 9. The first divider's output 353 has 25% of the positive supply's voltage, the second divider's output 354 has 17% of the positive supply's voltage, the third divider 355 has 11% and the fourth divider 356 has 8.4% of the output. These are just example values and the ratios may vary in other embodiments of this invention. Since each transistor has a different voltage ratio on its base, they will turn on at different portions of the sine wave input.

Figure 5:
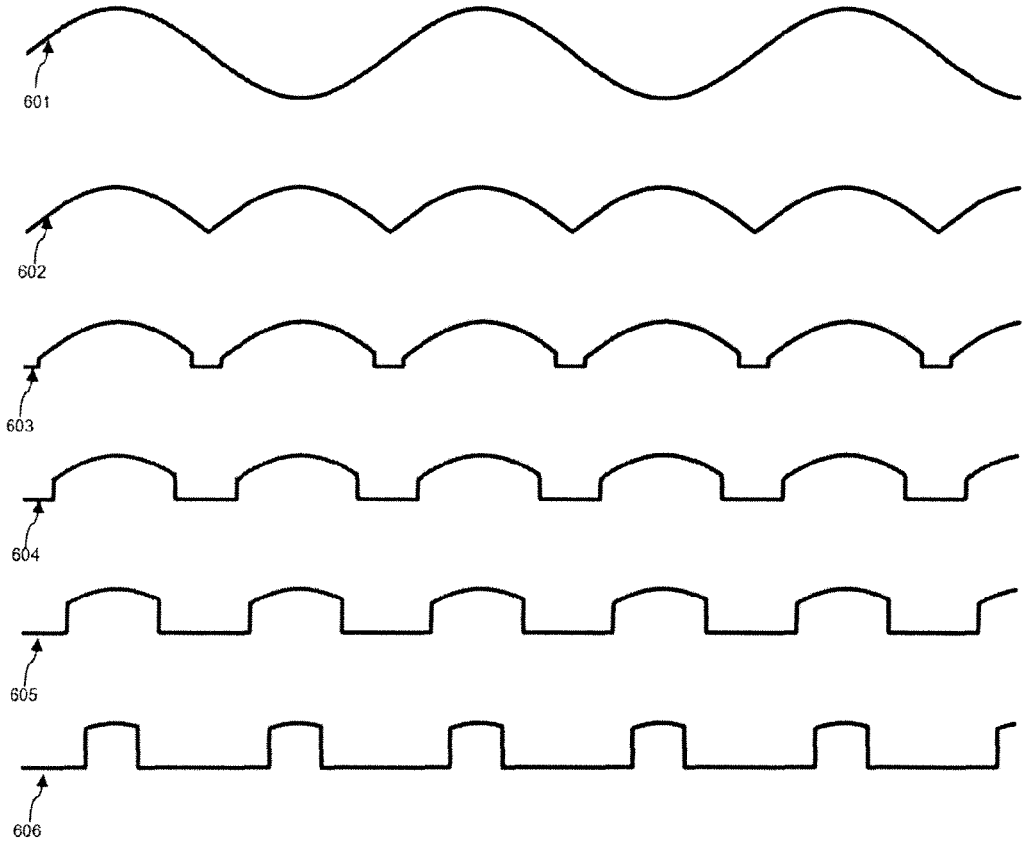
FIG. 5 illustrates signal waveforms with the circuitry to be implemented using a conventional external dimmer control.

The first waveform 601 in FIG. 5 is representative of the input sine wave. These waveforms are applicable to an external dimmer. Typically power line frequency is fixed at either 60 Hz in the US and some countries and 50 Hz in other countries. After the sine wave goes through the full wave rectifier, it is converted into a full wave rectified sinusoid 602, sometimes called "pulsating AC". The following four waveforms are the current waveform that flows through four LED banks. The first one 603 is on with current flowing most of the time yielding a bright LED output. The second one 604 is on for less time, the third one 605 is on for even less time and the fourth one 606 is only on briefly which is indicative of extreme dimming. As the voltage dimmer control is adjusted to dimmer settings, all of the current waveforms will narrow. With more dimming, waveform 606 will go down to zero and turn off the associated LED array. With more dimming waveform 605 will go down to zero. Eventually, with more dimming, the two other arrays will dim and then extinguish. Although the LED arrays are a series electrical connection for each bank, the LEDs from each of the banks can be dispersed in a semi-random physical layout near each other so that it will appear that some of the lights are extinguishing within the spatial array while others are dimming.

FIG. 6 applies to the PWM input implementation of this invention. If the PWM signal was on 100% of the time (zero voltage going into the opto-coupler) the resulting LED array current waveform would be 703. If the PWM signal was approximately 40%, it would look like 704. As the PWM signal's duty cycle is reduced to less than 40% it would look like 705, 706 and finally 707 which represent extreme dimming.

Figure 7:
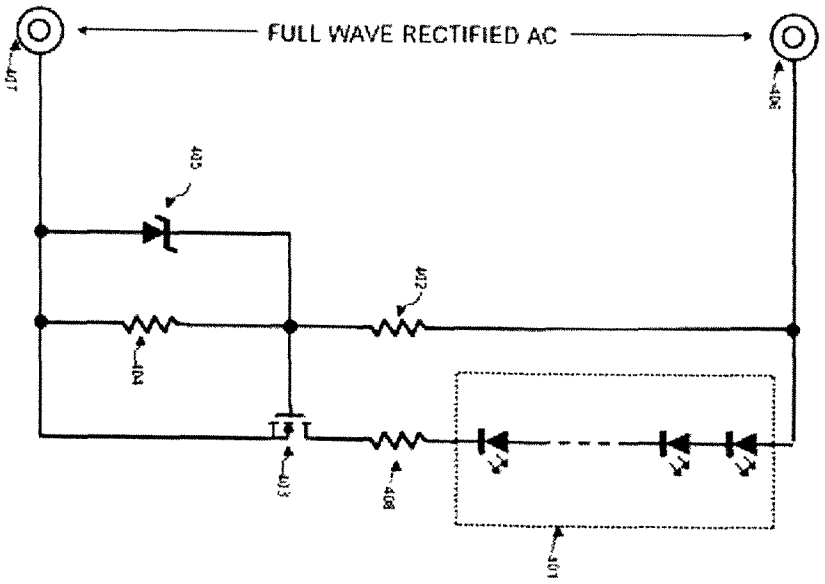
FIG. 7 illustrates a detailed circuit of a single driver bank.

FIG. 7 is a detailed view of a single LED bank switch circuit. The zener diode 405 prevents the voltage divider's 402, 404 voltage from exceeding $V_Z$, the zener diode's breakdown voltage. This component is typically selected to have 10 VDC zener voltage. This protects the gate input of the transistor 403. The LED array is shown as three LEDs, but it can actually be one or more LEDs. The LED current is set by the current limiting resistor 408. Applied to the circuit is full wave rectified AC from 406 and 407.

Figure 8:
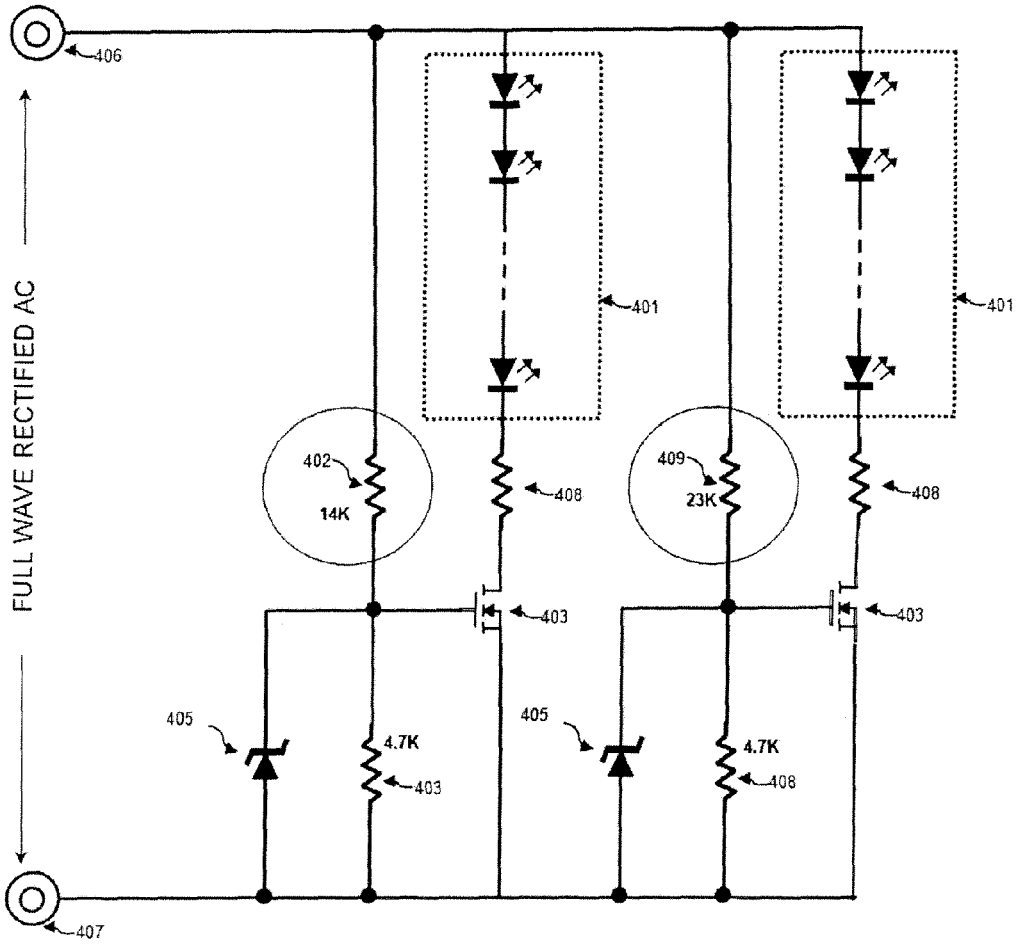
FIG. 8 shows detailed circuitry for a dual driver bank. The critical differences between the two banks are encircled to show the difference between the two banks.

FIG. 8 highlights the difference in the resistance dividers. The resistors 402 and 409 can be seen to have different values.

While the preferred embodiment of the invention has been described, modifications can be made and other embodiments may be devised without departing from the spirit of the invention and the scope of the appended claims.

What is claimed is:

1. An LED dimmer circuit, comprising an AC power source; the AC power source having inputs a full wave rectifier, the AC power source inputs entering the full wave rectifier;

a plurality of LED banks connected in series, spatially arrayed to be optically close to one another, a positive output of the full wave rectifier being fed to a positive input of said plurality of LED banks;

a plurality of switching circuits for applying dimming signals to said plurality of LED banks, each LED bank having its own switching circuit, said dimming signals being controlled by a control signal conducting current through the plurality of LED banks based on a controller setting wherein varying said controller setting reduces the illumination of individual LED banks included in the plurality of LED banks; and a plurality of control circuits for generating said control signal to control said switching circuits so that said dimming signal applied to each individual LED bank in response to said control signal is different for each individual LED bank.

2. The LED dimmer circuit in accordance with claim 1 wherein said controller setting is determined in part by an instantaneous phase angle of said AC power source.

3. The LED dimmer circuit in accordance with claim 2 wherein each of said plurality of control circuits includes in part a resistance divider network which controls a voltage level applied to each of said switching circuits.

4. The LED dimmer circuit in accordance with claim 3 wherein said resistance divider network includes in part at least two resistors with the value of one of the resistors being different for each switching circuit.

5. The LED dimmer circuit in accordance with claim 3 wherein said the voltage level is different to each of said switching circuits.

6. The LED dimmer circuit in accordance with claim 1 wherein said controller setting is determined in part by a voltage magnitude.

7. The LED dimmer circuit in accordance with claim 1 wherein the LED dimmer circuit is driven by a series external manually controlled light dimmer, the controlled light dimmer switching current on and off.

8. The LED dimmer circuit in accordance with claim 1 wherein the LED dimmer circuit is driven by external control input consisting of a pulse modulated digital control signal.

9. The LED dimmer circuit in accordance with claim 1 wherein one of the plurality of LED banks is off while the other LED banks remain on for a longer duration then the off LED bank, additional LED banks being turned off as more dimming is required.

10. The LED dimmer circuit in accordance with claim 1 wherein said controller setting is determined in part by an external pulse width modulated signal and the duration of the control signal.

11. The LED dimmer circuit in accordance with claim 10 wherein each of said switching circuits includes in part a switching device to apply power to said LED banks, said switching device being either in an on state or on off state with each state being dependent on said voltage level applied to said switching circuit.

* * * * *